United States Patent [19]

Koyase et al.

[11] Patent Number: 4,642,138

[45] Date of Patent: Feb. 10, 1987

[54] METHOD OF PREVENTING DEPOSITION OF SLUDGE IN LIQUID TANK AND OF REMOVING DEPOSITED SLUDGE

[75] Inventors: Hiroyasu Koyase; Kinsaku Funaki; Atsuo Morita, all of Ibaraki, Japan

[73] Assignees: Kashima Engineering Co., Ltd., Ibaraki; Taiho Industrial Co., Ltd., Tokyo, both of Japan

[21] Appl. No.: 706,980

[22] Filed: Mar. 1, 1985

[30] Foreign Application Priority Data

Mar. 24, 1984 [JP] Japan ..... 59-56884

[51] Int. Cl.[4] ..... B08B 3/02

[52] U.S. Cl. ..... 134/22.18; 134/24; 137/15; 210/803

[58] Field of Search ..... 134/21, 22.18, 24, 167 R, 134/172; 210/696, 803, 197, 257.1, 258, 523, 525, 219; 239/227, 240; 137/15, 563

[56] References Cited

U.S. PATENT DOCUMENTS

| | | | |
|---|---|---|---|
| 3,874,399 | 4/1975 | Ishihara | 134/24 |
| 3,895,756 | 7/1975 | Jaeger | 134/167 R |
| 4,192,332 | 3/1980 | Feldmeier | 134/24 |
| 4,407,678 | 10/1983 | Furness et al. | 134/167 R |
| 4,426,233 | 1/1985 | Manabe et al. | 210/258 |

*Primary Examiner*—Peter Hruskoci

*Attorney, Agent, or Firm*—Schwartz, Jeffery, Schwaab, Mack, Blumenthal & Evans

[57] ABSTRACT

In a method of preventing deposition of sludge and of removing deposited sludge, liquid spray devices installed at predetermined positions in a tank are driven by a pressure of a liquid sprayed therefrom, the liquid sprayed from the spray devices is sprayed at a predetermined speed in the tank, and the flow of the liquid removes sludge deposited in the tank.

7 Claims, 3 Drawing Figures

METHOD OF PREVENTING DEPOSITION OF SLUDGE IN LIQUID TANK AND OF REMOVING DEPOSITED SLUDGE

BACKGROUND OF THE INVENTION

1. Field of the Invention

The present invention relates to a method of preventing deposition of sludge in a liquid tank such as a crude oil tank, a storage tank for rubber or the like, or a water treatment sludge tank, and of removing deposited sludge.

2. Description of the Prior Art

When crude oil is stored in a tank for a long period of time, a clay-like sludge consisting of wax, asphaltene, debris, or water in crude oil, deposits on the bottom of the tank. Although the properties and amounts of such sludge differ in accordance with the type of oil, storage time or method of storage, sludge frequently deposits to a height of 5 m. When such sludge is left unremoved, the oil storage capacity is lowered. In addition, various problems occur such as inclining of a floating roof or constriction of an oil flow path. For these reasons, sludge must be periodically removed or its deposition must be prevented.

Various conventional methods for preventing deposition of sludge in a crude oil tank are known. According to one method, an agitator is installed inside a tank. The agitator is used to agitate the crude oil to impart a flow thereto, thereby preventing deposition of sludge. However, with recent trends toward larger tanks and import of low-quality crude oil, the above-mentioned method cannot satisfactorily prevent deposition of sludge within the entire tank. This method can provide only an agitation effect near the agitator.

In view of this problem, the coapplicant of this application earlier proposed a technique as per Japanese Utility Model Disclosure No. 51-36119 (to be referred to as a basic technique hereinafter). According to this technique, an upright nozzle is arranged at a given position within a crude oil tank. A spray device is mounted on the upright nozzle so as to rotate or pivot while spraying a liquid (oil). The spray device is driven by utilizing a hydraulic pressure obtained when the crude oil in the tank circulates or when oil is externally supplied, thereby constantly spraying oil around the upright nozzle and agitating the crude oil inside the tank.

According to this basic technique, oil sprayed from the nozzle allows agitation of crude oil within the entire tank. This technique can resolve problems that arise with conventional techniques. In addition, according to the basic technique, the sprayed oil is streamed against the sludge deposition layer on the bottom of the crude oil tank so as to break up the deposited sludge and allow it to be redissolved in the crude oil.

However, in order for sludge deposited on the bottom of the crude oil tank to be broken up and agitated by oil sprayed from a nozzle, considerably high pressure and spray energy are required. However, the spray capacity of a spray device is limited. In addition, since various accessories including a roof drain pipe are installed inside the tank, few spray devices can be installed without technical difficulty and at economical cost.

Even if oil sprayed from the nozzle has energy capable of breaking up the sludge, the sludge may not actually be broken up or agitated depending upon the installation position of the spray device and the tank structure.

Furthermore, depending upon the installation position of the spray device in the tank, the sprayed oil acts on the tank side wall or the like, generating noise or causing vibration.

In order to obtain a good agitation effect with sprayed oil within the entire tank while resolving the above problems, the installation positions, spacing and installation method of the spray devices must be properly selected. However, many technical considerations are involved in resolving these problems. Even though almost ten years have passed since the advent of the basic technique, a practical technique which provides a solution to all the problems has not yet been proposed.

For this reason, even if sludge deposited in a tank can theoretically be removed by the basic technique, until now when sludge is actually deposited in the tank, it has been removed manually after draining the tank.

However, the manual method of removing sludge after draining the tank requires much labor and time, and the process is very dangerous.

SUMMARY OF THE INVENTION

The present invention has been made in consideration of the above-mentioned problems and has been established based on various studies and experiments made over a long period of time.

It is an object of the present invention to provide a method of preventing deposition of sludge and of removing deposited sludge, wherein a sprayed flow of oil can effectively act within an entire tank, so that sludge can be completely removed irrespective of sludge deposit location.

In order to achieve the above and other objects of the present invention, there is provided a method of removing sludge deposited in a liquid tank such as a crude oil tank, a storage tank for rubber or the like, or a water treatment sludge tank by rotating a nozzle, wherein a spray device is installed so that the distance between the bottom of the tank and the nozzle is 0.5 to 3.0 m, and the spray device is located at a suitable position within the tank so that a flow speed of a liquid sprayed from the spray device is at least 0.3 m/sec at any position within the tank, thereby providing a liquid flow speed which upon impact against the tank side wall is 2.4 m/sec or less.

According to the present invention, the spray device is installed so that the distance between the bottom of the tank and the nozzle is 0.5 to 3.0 m. At the same time, the spray device is located at a suitable position within the tank so that a flow speed of liquid sprayed from the spray device is 0.3 m/sec or more, and preferably, 0.4 m/sec or more, at any position in the tank. When sludge is removed under these conditions, sludge can substantially be completely removed with a best efficiency and a minimum number of spray devices. Moreover, a sludge removal apparatus which is technically easy to realize and inexpensive can be provided.

According to the present invention, the spray device is arranged so that the liquid flow speed on impact against the tank side wall becomes 2.4 m/sec or less. Therefore, vibration is not caused due to installation of spray devices, and cracking or like damage to the tank will not occur upon use over a long period of time, thus providing a very safe sludge removal apparatus.

The method of the present invention is not limited to crude oil tanks but can be applied to other types of liquid tanks such as storage tanks for rubber or the like or water treatment sludge tanks.

The effects of the present invention will become apparent from the description of the embodiments.

DETAILED DESCRIPTION OF THE PREFERRED EMBODIMENT

The preferred embodiment of the present invention will be described with reference to experimental results obtained in the sludge removal apparatus to be described below.

Figure 1:
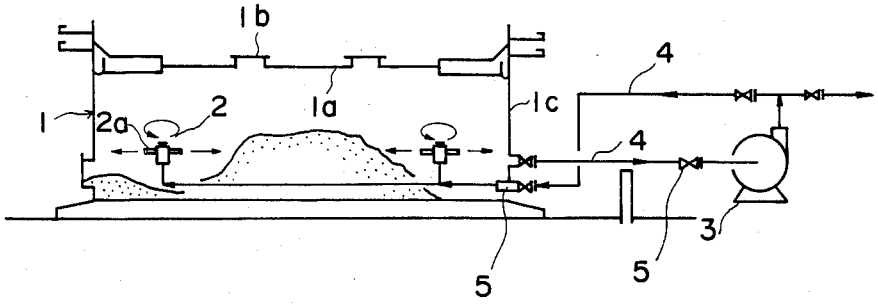
FIG. 1 is a schematic side view showing the schematic construction of a sludge removal apparatus used in an experiment according to the present invention.

FIG. 1 shows the main construction of the sludge removal apparatus to be used in the experiment conducted according to the present invention.

A crude oil tank 1 has a floating roof 1*a* which is vertically movable in accordance with the level of crude oil contained therein. The crude oil tank 1 is of a maximum scale used in Japan; it has a diameter of 80 to 85 m and a capacity of 100,000 kl.

Spray devices 2 are arranged on a circle and each has a pair of nozzles 2*a* facing oppositely along the tangential direction of the circle. Each spray device 2 sprays from its nozzles 2*a* crude oil supplied from an external pump 3 while being rotated or pivoted. In order to allow easy experimentation (to be described later), the spray devices 2 are suspended inside the tank using manholes 1*b* of the tank floating roof 1*a* so that the installation levels and positions of the devices 2 can be variously changed. Piping 4 connects between the spray devices 2 and the external pump 3 and a valve 5 controls the open/closed state of the piping 4.

Main specifications of each such spray device 2 will be described below. A rotary jet mixer having a nozzle 2*a* of 75 mm diameter available from Taiho Kogyo K.K. is used as each device 2. Each nozzle has a delivery rate of 0 to 1,200 kl/hr and a delivery pressure of 0 to 6.0 kg/cm$^2$. The internal mechanism is set so that the rotational frequency of each device 2 in crude oil is 1 to 2 rotations per hour. The angle of nozzles 2*a* can be changed along the vertical direction.

The results of experiments conducted using the above-mentioned apparatus will be described in detail below.

Experiment 1

In order to examine the relationship between the liquid flow speed at the sludge impact position and the sludge break up effect, the sludge break up effect was examined at liquid flow speeds at sludge impact positions of 0.6 m/sec, 0.5 m/sec, 0.4 m/sec, 0.3 m/sec and 0.2 m/sec.

Experiment Conditions

The crude oil used was Maya crude oil. After setting the crude oil flow rate at 700 kcal/hr and the delivery pressure at 4.0 kg/cm$^2$, the distance between the sludge surface and each spray device was set to be 17 m (flow speed 0.6 m/sec), 20 m (0.5 m/sec), 25 m (0.4 m/sec), 32 m (0.3 m/sec), and 42 m (0.2 m/sec).

As a result, when the flow speed was 0.3 m/sec or more, sludge could substantially be completely removed. Sludge could be completely removed when the flow speed was 0.4 to 0.5 m/sec or more.

Figure 2:
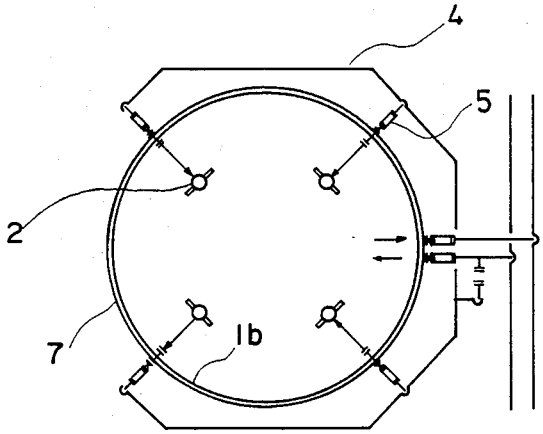
FIG. 2 shows a layout of spray devices arranged according to the present invention.
Figure 3:
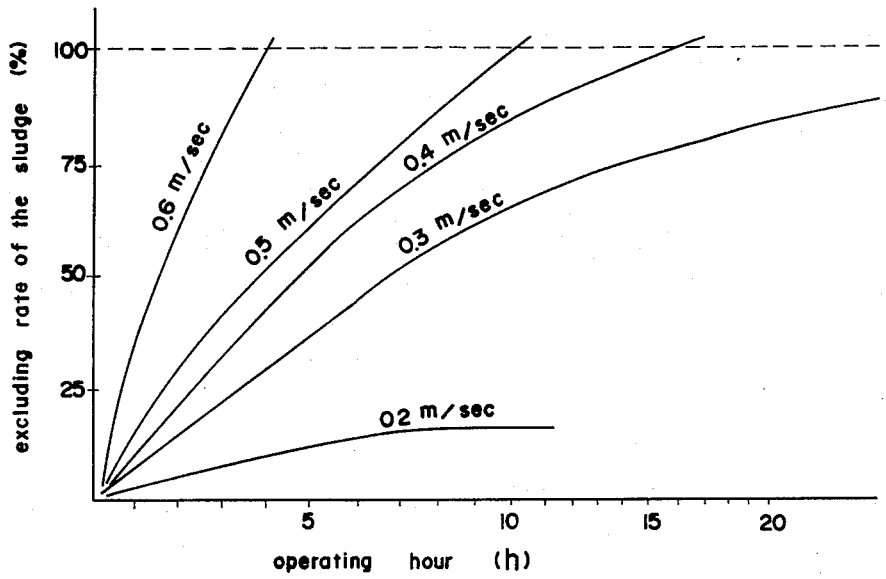
FIG. 3 is a graph showing the relationship between the sludge removal ratio and operation time.

Based upon the above results, a plurality of spray devices 2 were arranged at symmetrical positions inside the tank substantially intermediate between the center and the side wall of the tank, as shown in FIG. 2. The installation level of the devices 2 was set at 1.8 m and installation interval was set to be 20 m (corresponding to a flow speed of 0.5 m/sec or more at any position in the tank), 25 m (0.4 m/sec or more), or 32 m (0.3 m/sec or more). Thereafter, nozzles of the devices were slightly inclined downward and the devices were continuously operated for 44 hours.

TABLE 1

| Flow Speed | 0.5 m/sec | 0.4 m/sec | 0.3 m/sec | 0.2 m/sec |
|---|---|---|---|---|
| Sludge amount before operation | 2260 m$^3$ | 2210 m$^3$ | 1930 m$^3$ | 2090 m$^3$ |
| After operation | None; 36 h | Slight amount | 130 m$^3$ | 1400 m$^3$ |

Note that in the above table, 36 h represents the operation time for sludge removal.

In accordance with the results presented above, when the flow speed is 0.2 m/sec or more, 60% or more of sludge remains unremoved. When the flow speed is 0.3 m/sec, 90% or more of sludge is removed, thereby providing an effective removal performance.

However, in order to provide a complete sludge removal effect, the flow speed must be 0.4 m/sec or more. The flow speed is preferably 0.5 m/sec or more for complete removal of sludge.

Experiment 2

In order to examine the relationship between the installation level of the spray devices 2 and the sludge break up effect, the installation level was set at 1 m, 2 m, 3 m, and 4 m. The spray devices 2 were arranged to achieve a flow speed of 0.5 m/sec under the experimenting conditions of Experiment 1 and changes in the amount of sludge deposited in the tank 1 were examined.

TABLE 2

| Mounting height | 1 m | 2 m | 3 m | 4 m |
|---|---|---|---|---|
| Sludge amount before operation | 1907 m$^3$ | 2257 m$^3$ | 1853 m$^3$ | 2077 m$^3$ |
| After operation | None; 17 h | None; 36 h | Slight amount | 982 m$^3$ |

Note that in the above table, 17 h and 36 h represent the operation time for sludge removal.

As can be seen from the above experimental results, the lower the nozzles 2*a* are located, the better the sludge breaking effect. However, if the nozzles 2*a* are too close to the bottom of the tank 1, the spray device may not operate due to pressure of the sludge. For this reason, it was found that the nozzles 2*a* are preferably located at levels within the range between 0.5 to 3.0 m and preferably within the range between 1 and 2.5 m.

Experiment 3

In order to examine the relationship between the flow speed and vibration and noise when the sprayed oil impacts against a side wall 1*c* of the tank, the spray devices were arranged so that the sprayed flows impacted against portions below the roof 1*a* where vibration was most apt to occur. The distance between the spray devices and the tank side wall 1*c* was changed so that the speed flow at the impact point was 3 m/sec (distance of the spray device from the side wall: 2 m), 2.5 m/sec (distance: 4 m), 2 m/sec (distance: 7 m), and 1.5 m (distance: 10 m).

As a result of the experiment, it was confirmed that when the flow speed was 2.5 m/sec, the columns of the floating roof 1*a* slightly vibrated and when the flow speed exceeded 3 m/sec, the columns vibrated heavily. The noise was 60 phons at a point 1.5 m from the outer wall surface of the tank, thus presenting no problem.

It can be seen from the above results that the flow speed at impact point against the side wall 1*c* of the tank must be set to be 2.4 m/sec or less.

Since sludge tends to collect near the tank side wall 1*c* and since vibration must be reduced to a minimum, better sludge break up effect and better vibration control can be obtained if the sprayed liquid is not brought into direct contact with the side wall 1*c* and the nozzles 2*a* of the spray devices are inclined slightly downward so that the sprayed liquid impacts against the lower portion of the side wall 1*c* of the tank.

What is claimed is:

1. A method of preventing deposition of sludge and removing deposited sludge within a liquid tank having a side wall surface and a bottom, said method comprising the step of spraying a liquid through a plurality of rotatable spray devices arranged at predetemined positions in said tank, wherein said sprayed liquid is of the same type as in said tank; said spray devices have spray nozzles with a downwardly inclined spraying direction; said nozzles are 0.5 to 3.0 meters above said bottom of said tank, and liquid sprayed from said spray devices has a minimum flow speed of at least 0.3 meters per second at any position inside said tank and impinges against said side wall surface at a flow speed from 0.3 to 2.4 meters per second.

2. A method according to claim 1, wherein said liquid tank is a crude oil tank, and the liquid sprayed from said spray devices is crude oil.

3. A method according to claim 1, wherein said spray devices are arranged in said tank so that the distance between said bottom of said tank and said nozzles is 1.0 to 2.5 meters.

4. A method according to claim 1, wherein the minimum flow speed of liquid sprayed from said spray devices is at least 0.5 meters per second at any position inside said tank.

5. A method according to claim 1, wherein said rotatable spray devices are driven by pressure of the liquid sprayed therefrom.

6. A method according to claim 5, wherein liquid from outside said tank is sprayed through said spray devices into said tank.

7. A method according to claim 5, wherein liquid from inside said tank is internally circulated through said spray devices.

* * * * *